US005526796A

United States Patent [19]

Thring et al.

[11] Patent Number: 5,526,796

[45] Date of Patent: Jun. 18, 1996

[54] AIR ASSISTED FUEL INJECTOR WITH TIMED AIR PULSING

[75] Inventors: Robert H. Thring, Devine; Evan S. Guy, San Antonio, both of Tex.

[73] Assignee: Southwest Research Institute, San Antonio, Tex.

[21] Appl. No.: 252,018

[22] Filed: Jun. 1, 1994

[51] Int. Cl.[6] ..... F02M 69/08; F02M 67/02

[52] U.S. Cl. ..... 123/531; 239/5; 239/408; 239/585.1

[58] Field of Search ..... 123/531, 533; 239/5, 408, 415, 585.1, 585.2, 585.3, 585.4, 585.5

[56] References Cited

U.S. PATENT DOCUMENTS

| | | | |
|---|---|---|---|
| 3,987,771 | 10/1976 | Oglesby | 123/445 |
| 4,434,766 | 3/1984 | Matsouka et al. | 123/472 |
| 4,508,273 | 4/1985 | Firey | 239/427 |
| 4,592,328 | 6/1986 | Firey | 123/531 |
| 4,712,524 | 12/1987 | Smith et al. | 123/198 A |
| 4,759,335 | 7/1988 | Ragg et al. | 123/531 |
| 4,760,832 | 8/1988 | Smith et al. | 123/525 |
| 4,794,902 | 1/1989 | McKay | 123/533 |
| 4,846,114 | 7/1989 | List | 123/26 |
| 4,938,417 | 7/1990 | Halvorsen | 239/5 |
| 4,945,886 | 8/1990 | McKay et al. | 123/533 |
| 4,962,889 | 10/1990 | Halvorsen | 239/410 |
| 4,974,571 | 12/1990 | Oppenheim et al. | 123/531 |
| 4,979,479 | 12/1990 | Furukawa | 123/472 |
| 5,020,504 | 6/1991 | Morikawa | 123/531 |
| 5,024,202 | 6/1991 | McKay | 123/533 |
| 5,046,472 | 9/1991 | Linder | 123/533 |
| 5,048,497 | 9/1991 | Kishida et al. | 123/533 |
| 5,101,800 | 4/1992 | Schumann et al. | 123/531 |
| 5,102,054 | 4/1992 | Halvorsen | 239/533.2 |
| 5,113,829 | 5/1992 | Motoyama | 123/531 X |
| 5,148,788 | 9/1992 | Saikalis et al. | 123/339 |
| 5,150,836 | 9/1992 | McKay et al. | 239/5 |
| 5,156,130 | 10/1992 | Soma | 123/472 |
| 5,170,766 | 12/1992 | Haas et al. | 123/531 |
| 5,174,505 | 12/1992 | Shen | 239/417.3 |
| 5,190,216 | 3/1993 | Deneke | 239/5 |

*Primary Examiner*—Tony M. Argenbright

*Attorney, Agent, or Firm*—Robert C. Curfiss; Butler & Binion

[57] ABSTRACT

A fuel injector valve controls both the metered flow of fuel and the metered flow of air into a mixing chamber, permitting intermittent, cyclic flow of both air and fuel into the chamber. The controlled cycling of both the air and fuel flow permits optimization of fuel performance. A single action valve and a dual action valve are disclosed. The air flow and fuel flow may be independently adjusted for maximum flexibility.

34 Claims, 3 Drawing Sheets

FIG. 3
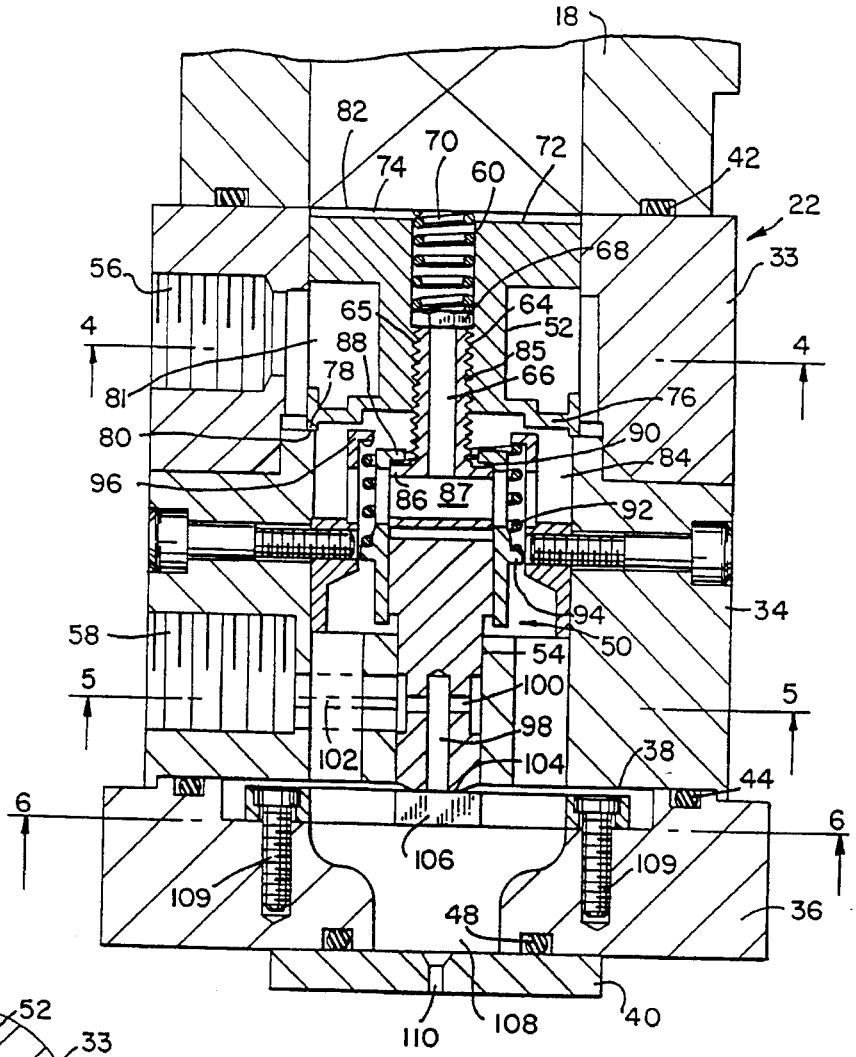
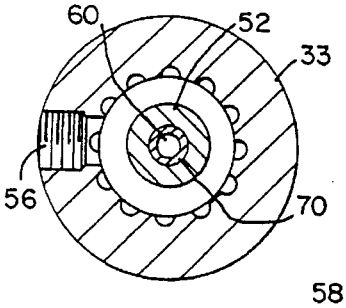
FIG. 4
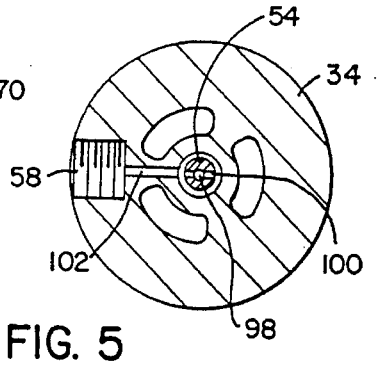
FIG. 5
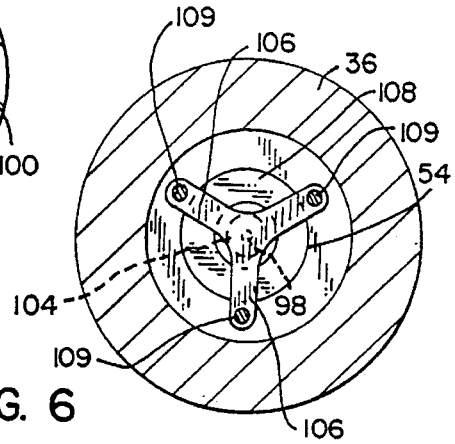
FIG. 6

FIG. 7
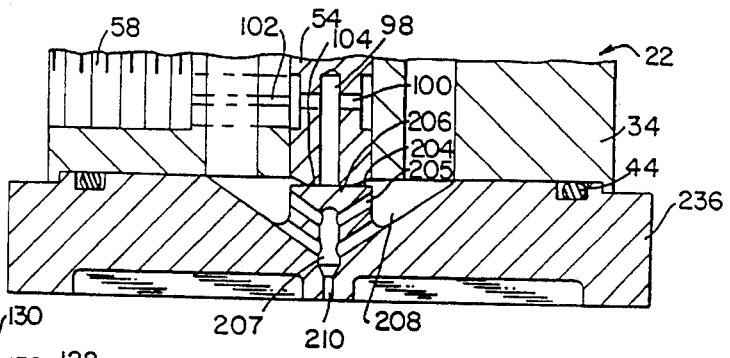
FIG. 8
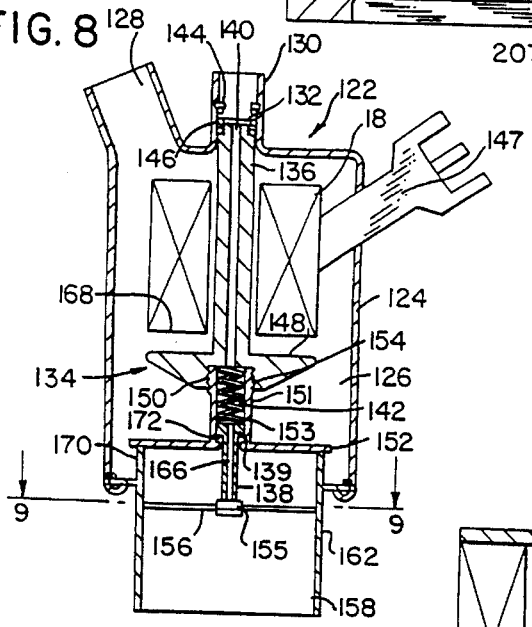
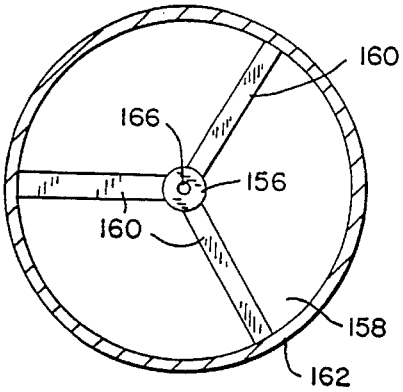
FIG. 9
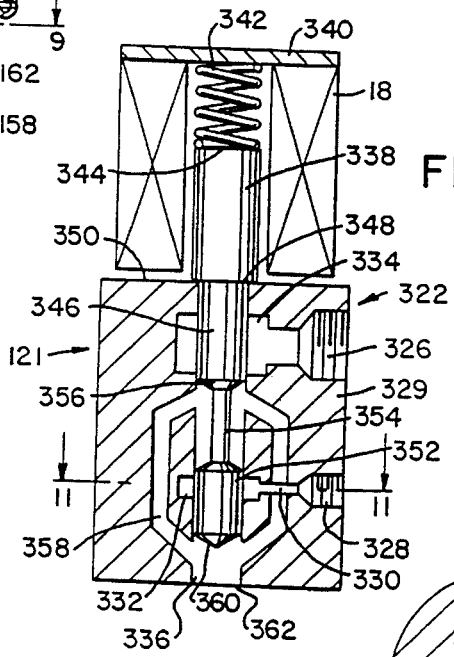
FIG. 10
FIG. 11
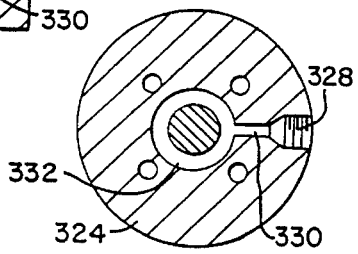

AIR ASSISTED FUEL INJECTOR WITH TIMED AIR PULSING

BACKGROUND OF INVENTION

1. Field of Invention

The subject invention is related to fuel injectors, in general, and is specifically related to a fuel injector valve controlling and motoring both the air flow and fuel flow into a mixing chamber.

2. Description of the Prior Art

Fuel injector valves are well known mechanisms for controlling the air/fuel ratio of a gasified or atomized fuel-air mixture in an internal combustion engine. Fuel injection was first widely applied to diesel engines where injection of the fuel directly into the cylinder was required. Diesel fuel is heavier and less volatile than gasoline thus very high pressure was needed to properly atomize the fuel. The first automobile gasoline fuel injectors were direct, mechanical fuel injectors developed by Bosch and Mercedes-Benz in the early 1950s. These fuel injectors pumped the fuel either directly into the cylinder or into an intake manifold. High pressure injection pumps, directly driven from the engine, discharged fuel through rigid tubing to the nozzle. The nozzle discharge pressures were about 1500 psi to properly atomize the fuel. The fuel pressure overcame a spring loaded valve in the injector body which eliminated the need for a return fuel line. In the late 1950's Mercedes-Benz began developing a port injection which could use lower fuel pressures, as the injection did not have to overcome combustion chamber pressures. This was first used in the 1957 Mercedes-Benz 300 and port-type injectors have been increasingly used since then.

Early electronic fuel injection systems delivered a pressurized fuel supply (typically 20 to 100 psi) to each injector from a fuel pump which supplied the mechanical energy required for atomization. The injector body contained a solenoid, which when energized, allowed fuel to pass into the nozzle. Although this design has been improved, particularly the controlling electronics, the basic operation has remained the same to this day.

Gianini, U.S. Pat. No. 3,610,213, discloses a fuel injector for minimizing inconsistent air/fuel ratios, pulsations caused by the high frequency of breaks in the fuel stream (caused by the cycling of the injectors), and improper fuel storage in the intake manifold. Gianini's invention consists of a fuel injection system having a separate fuel source, an injector having a fuel reservoir at least as great as the volume of fuel to be injected into the cylinder, a mechanical pump to supply fuel from the fuel source to the injector reservoir, an air source, and a separate pump to supply the air to the injector to atomize the fuel in the reservoir.

Another fuel injector design is disclosed in Sarich U.S. Pat. No. 4,462,776. That patent discloses a method and apparatus for delivering metered quantities of liquid wherein the liquid is circulated through a metering chamber, filling the chamber with the liquid, closing the circulation ports when the metering chamber is full, opening a gas inlet port and a discharge port and admitting gas under pressure through the gas inlet port into the metering chamber and expelling the liquid from the metering chamber to the discharge port. Once the liquid is expelled, the gas inlet port and the discharge ports are closed and the fuel is again circulated through the metering chamber. The amount of liquid in the metering chamber can be regulated only by moving the gas in the port mechanism so as to define a larger or smaller cavity.

An attempt to minimize cycle-to-cycle variation in fuel delivery caused by the buildup of a residual fuel is disclosed in Smith U.S. Pat. No. 4,712,524. Smith discloses that an average thickness of the residual fuel film on the wall of the fuel delivery tube between the metering device and the engine increases as the metered quantity of fuel for delivery increases, when a fixed amount of air is used to convey the fuel through the delivery tube. To resolve this problem, Smith teaches a method of delivering fuel to an internal combustion engine comprising the delivering of individual metered quantities of fuel into a conduit by an individual air pulse, and establishing a secondary gas flow in the conduit to sweep the conduit clean. The secondary gas flow would only occur for part of the time interval between the respective air pulses to deliver the metered quantities of fuel along the conduit. The individual air pulses do not meter the fuel as metering is accomplished using standard metering devices.

The McKay U.S. Pat. No. 5,024,202 discloses a valve structure having a single plunger which includes a first tapered valve for controlling air flow and a second flared valve for delivering the air/fuel mixture. However, this patent does not disclose a method for simultaneously controlling and metering both the air and the fuel into the chamber. The U.S. Pat. No. 5,024,202 describes a solenoid operated fuel injector using a common needle to switch on and off the flows of both fuel and air. The major disadvantage to this system is that both valves open simultaneously, possibly resulting in a danger of poor atomization at the beginning and end of the fuel injection event.

McKay U.S. Pat. No. 4,794,902 discloses a similar solenoid actuated air/fuel metering valve also including a single plunger for implementing various fuel/air mixing injecting steps by metering the air. Again, this patent does not disclose a device for simultaneously metering the air and the fuel into the mixing chamber.

There remains a need to provide for a better atomization of the fuel in internal combustion gasoline engines, particularly under cold start conditions when there is an increased tendency for the fuel to remain unvaporized. Such good quality atomization cannot currently be obtained by conventional electronic atomizers operating at pressures in the region of three times atmospheric pressure. Atomization this good can be obtained with air assisted atomizers, but existing air assisted atomizers have a problem. They require continuous air flow which not only requires an extensive flow of compressed air resulting in a high compressor power requirement, but tend to make the engine run too lean by providing too high an air mix in the air/fuel ratio. Operation using only the pressure difference between the atmosphere and the manifold does not provide sufficiently fine atomization. While electronic fuel injectors are rapidly replacing entirely mechanical injectors because electronic fuel injectors allow greater monitoring of relevant factors and subsequent metering of the fuel and air mixture for combustion, there remains a need to develop a single valve capable of metering both the air and the fuel, to optimize the air/fuel mixture introduced into the manifold or the combustion chamber in order to increase the overall efficiency of the fuel delivery system and to improve related engine performance, especially the control of engine out emissions during cold start. To date, a single valve system which permits both the air and the fuel to be calibrated and precisely metered is not known.

SUMMARY OF THE INVENTION

The subject invention discloses an air assisted fuel injector that uses timed-air pulsing so that the air flow is only permitted during that part of the engine cycle when it is needed, rather than continuously. In addition, the invention recognizes that in order to achieve optimum atomization of the fuel introduced into the system, the air flow must be present prior to the time of fuel injection and must continue until after the fuel injection cycle is completed. In the past, this was accomplished by providing a continuous air flow which often resulted in too lean of an air fuel mixture. The subject invention cycles the air flow in a manner allowing the metered air flow to eclipse or both lead and lag the injection of fuel. It is a unique feature of the subject invention that this is accomplished utilizing a single valve construction having either a unitary action plunger with porting arranged to permit an air flow enveloping the fuel flow or a dual action single valve which may be calibrated to precisely adjust the fuel flow relative to the air flow.

The subject invention provides for an injector system wherein the air flow is cycled on and off, as needed in the mixing chamber to properly atomize a metered fuel. It is particularly unique to the subject invention that the fuel metering and the air cycling are provided by a single fuel injector valve requiring single solenoid operation. This permits the use of the timed air pulsing fuel delivery system without requiring an increase in the number of actuator components and valve systems in the engine fuel delivery system. A single control means such as a solenoid actuator is used to sequence both the flow of fuel and the flow of air into the system, with the mechanical components of the valve being constructed to time and meter both the air and the fuel flow.

In one embodiment of the invention, the valve includes a single plunger having porting uniquely designed to permit air flow only during the injection cycle, wherein the air flow both precedes and lags the fuel flow, to provide adequate air movement at the initiation and through the complete cycling of the metered fuel injection, optimizing atomization while at the same time minimizing the amount of air flow required for proper fuel delivery. In a second embodiment of the invention, the single plunger is modified to have a secondary plunger component which operates with, but independently of the primary plunger component, in response to a single solenoid actuator. By utilizing the secondary plunger component, the dual plunger action can be calibrated such that the fuel metering function may be adjusted independently of the air metering function of the valve.

Therefore, the subject invention specifically discloses a new and improved method for injecting a fuel-air mixture into a fuel delivery system for an internal combustion engine by introducing both the liquid fuel into the fuel delivery system and the flow of pressurized air for properly atomizing the liquid fuel on a timed and metered basis. This may be accomplished utilizing a single actuator for initiating both the air flow and then the fuel flow steps.

It is, therefore, an object and feature of the subject invention to provide a fuel injector system for metering both the air flow and the fuel flow on a timed basis, wherein both the use of air and the introduction of fuel is monitored to maximize atomization and to minimize the air consumption of the air assisted fuel injector, permitting optimization of air fuel ratio to the engine.

It is another object and feature of the subject invention to provide a fuel injector valve which is responsive to a single actuator to meter both the air flow and the fuel flow into the mixing chamber of a fuel delivery system.

It is an additional object and feature of the invention to provide a single actuator controlled fuel injector valve for metering both the air flow and fuel flow, wherein the air flow and fuel flow metering may be calibrated relative to one another.

Other objects and features of the invention will be readily apparent from the accompanying drawings and detailed description of the preferred embodiment.

BRIEF DESCRIPTION OF THE DRAWINGS

FIG. 3 is a longitudinal cross-section of a first embodiment of a single actuator fuel injector valve in accordance with the subject invention.

FIG. 4 is a cross-section taken generally along the lines 4—4 of FIG. 3.

FIG. 5 is a cross-section taken generally along the line 5—5 of FIG. 3.

FIG. 6 is a cross-section taken generally along the line 6—6 of FIG. 3.

FIG. 7 is an alternative embodiment of the mixing chamber and fuel release port utilizing the valve configuration of FIG. 3.

FIG. 8 is a longitudinal cross-section of an alternative embodiment of a fuel injector valve in accordance with the subject invention.

FIG. 9 is a cross-section taken generally along the line 9—9 of FIG. 8.

FIG. 10 is a longitudinal cross-section of another alternative embodiment of a fuel injector valve in accordance with the subject invention, utilizing a single plunger action for metering both the fuel and air cycles.

FIG. 11 is a cross-section taken generally along the line 11—11 of FIG. 10.

DETAILED DESCRIPTION OF THE PREFERRED EMBODIMENTS

Figure 1:
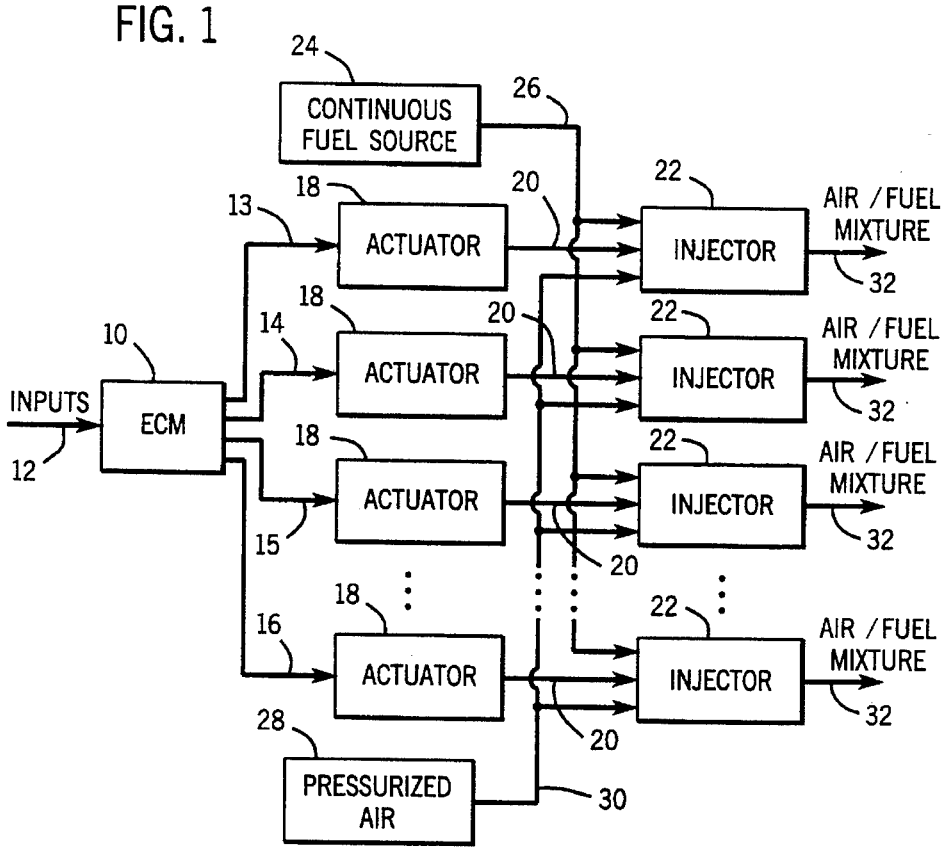
FIG. 1 is a flow chart illustrating the air and fuel metering system utilizing a single actuator configuration in accordance with the subject invention.
Figure 2:
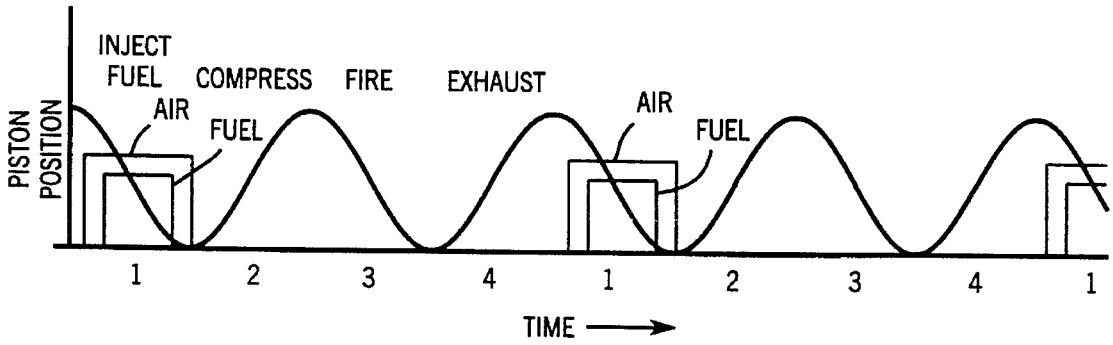
FIG. 2 is a diagrammatic timing diagram illustrating the timed pulse cycling of the air and fuel injection sequence in accordance with the subject invention.

A typical flow diagram utilizing the single actuator fuel injector of the subject invention is shown in FIG. 1. As there shown, a typical electronic fuel injection system includes an electronic control module 10 which is responsive to various inputs, in the well known manner, as indicated at 12. The control module 10 is responsive to the inputs to produce control signals on output lines 13, 14, 15, and 16 to each of the various actuators 18 for producing an energizing signal on each of the respective lines 20 for sequencing the respective fuel injectors 22. As illustrated in FIG. 2, in a typical four stroke engine the fuel injection cycle generally but not necessarily occurs in the downstroke of each piston. It is during this cycle, that the electronic control module 10 will produce an actuator signal to the related actuator 18 for introducing a fuel/air mixture into the chamber for combustion during the firing stroke of the piston. It will be readily recognized that the fuel injector system of the subject invention could be utilized with other types of internal combustion engines, such as, by way of example, two stroke engines and the like. Also, the air/fuel mixture indicated at line 32 can be introduced into a manifold for distribution or directly into an intake port in the cylinder. The control signal on lines 13–16 is dictated by the control module 10 and the injector mechanism 22 of the invention is independent of the particular sequence or engine configuration. It is an important feature of the invention that the fuel/air injection system is dependent only upon a single actuator 18 for each combustion chamber of the engine. With specific reference to FIG. 1, the actuator 18 is responsive to the control signal on the respective line 13, 14, 15, or 16, to produce an actuator or energizing signal on line 20 for sequencing the fuel injector 22 of the subject invention. It is unique to the subject invention that the injector controls and meters both the flow of fuel from the fuel source 24 via line 26 and the flow of pressurized air from the air source 28 via the line 30, to introduce a metered fuel and a metered air flow into a mixing chamber. This is diagrammatically indicated at each line 32 of FIG. 1, which represents the discharge port of the corresponding fuel injector 22.

Therefore, it is a unique feature of the subject invention that both metered air flow and metered fuel flow can be achieved utilizing a single injector 22 in combination with a single actuator 18. In the preferred embodiment, the actuator is typically a solenoid switch operable in response to control signal produced by the electronic control module 10. The injector is a mechanical valve having a single plunger responsive to the control signal 20 to control both the air flow and fuel flow discharged at port 32.

A plunger having a first control element for air flow and an independent second control element for fuel flow is shown in FIGS. 3–9. A single plunger relying on port configuration to control both air and fuel flow is shown in FIGS. 10–11. Calibration of the air flow relative to the fuel flow is provided the dual plunger action configurations of in FIGS. 3–9. Where the fuel flow and air flow portions of the cycle may be fixed relative to one another, the simpler and less costly configuration utilizing the single plunger of FIGS. 10–12 may be employed. With specific reference to FIGS. 3–6, the first embodiment of the injector valve 22 is shown coupled to a typical solenoid actuator 18 in the well-known manner. In the configuration shown, the injector valve 22 includes an air valve body 33 and a separate fuel valve body 34. A mixing chamber body 36 is coupled to the injector 22 and is in communication with the discharge end 38 of the injector valve 22. A discharge plate or orifice plate 40 is provided on the discharge end of the mixing chamber body 36. The actuator 18, air valve body 33, fuel valve body 34, mixing chamber body 36 and discharge plate 40 may be secured in the assembled configuration in any well-known manner such as, by way of example, four through bolts (not shown). As is typical, resilient O-ring seals 42, 44 and 48 may be provided between the various components to assure against fluid leakage. The embodiments of FIGS. 3–6 utilize a dual component plunger mechanism 50, comprising an air control component 52 and a fuel control component 54.

A supply aperture 56 is provided in the air valve body 33 and may be internally threaded to receive a coupling for connecting the air valve body to a source of pressurized air 28 (See FIG. 1). A similar aperture 58 is provided in the fuel valve body 34 and also may be internally threaded for receiving a coupling for connecting the fuel valve body to a continuous source of liquid fuel 24, as also indicated in FIG. 1.

As best seen in FIGS. 3 and 4, a central bore 60 is provided in the air control member 52 of the plunger 50. As drawn, the lower end of the bore 60 is internally threaded or tapped at 64. A threaded insert 65 is received in the threaded bore. The insert 65 has an enlarged head 86 and a central bore for receiving a bolt 66 or the like having a head 68. An air control compression spring 70 is inserted in the upper end of the bore 60 and seated against the head 68 of the bolt, with the opposite end of the spring 70 being seated against the end face 82 of the solenoid coil 18. The spring 70 normally urges the upper end 72 of the air valve control member 52 away from the coil 18 to provide a clearance 74.

When normally biased in this condition, the lower end 76 of the air control member is in its downward most position, as shown. The end 76 includes an outer, machined flange 78 which is adapted to seat against the circular air discharge seat 80 in the air valve body. When in this condition, the air flowing into aperture 56 is locked in the air chamber 81 in the air valve body. When the solenoid actuator 18 is actuated, the coil is operative to overcome the force of spring 70 and draw the air control member 52 upward, urging end face 72 into contact with the lower end 82 of the coil. This opens a gap between the seat 80 and the flange 78, permitting air to escape into the peripheral channel 84 of the fuel valve body 34.

The fuel control member 54 is carried by the air control member 52 and includes an upper cavity 87 adapted for receiving the enlarged head end 86 of the insert 85 to define a calibration mechanism. A flange 88 provided in the upper end of the fuel control member 54 engages the enlarged end 86 of the calibration mechanism insert. As shown, the distance between the enlarged end 86 and the flange 88 may be adjusted by turning the bolt 66, permitting the threaded insert 85 to turn relative to the threaded portion 64 of the bore 60, for adjusting the gap 90 between the insert end 86 and the flange 88. A fuel control biasing member such as the compression spring 92 engages a peripheral shoulder 94 provided on the control member 54 and a spring seat 96 provided in the fuel valve body. The spring 92 normally urges the fuel control member 54 into its most downward position.

The lower end of the fuel control member 54 includes an axial partial bore 98 which is in communication with a radial through channel 100. The channel 100 is in direct communication with the fuel supply tube or line 102 provided in the fuel valve body, see also FIG. 5. When the fuel control member 54 is in its lowermost position, the end 104 of the control member engages and closes against a fuel discharge seat 106. As better shown in FIG. 6, the fuel valve seat 106 comprises a bracket which is mounted over the mixing chamber 108 of the mixing chamber body 36. The bracket 106 may be mounted in the body 36 by a plurality of threaded fasteners 109, or by other suitable means.

In operation, when the solenoid coil 18 is actuated to draw the air control member 52 upward against the end face 82 of the actuator, the air closure flange 78 is moved upward and away from the air seat 80, permitting air to be discharged into the peripheral chamber 84 of the fuel valve body. After the air control member 52 has moved sufficient distance toward end face 82 of the actuator, the enlarged end 86 on the calibration insert 85 closes the gap 90 and engages the flange 88 on the fuel control member 54, lifting the fuel control member 54 upward from the fuel discharge seat 106, permitting fuel to be introduced into the fuel valve body via the needle valve defined by the bore 98 in the end 104 of the fuel control member 54. This releases fuel into the airstream already generated by the flow of air past the air seat 80. The fuel and air are then introduced into the mixing chamber 108 of the mixing chamber body 36 and released through the discharge orifice 110. The orifice plate or discharge plate 40 may be precisely machined to provide a controlled flow from the port 110.

At the end of the injection cycle, the actuator 18 is deactivated, permitting the spring 70 to bias and urge the plunger 50 back into its closed positions. As the air control member 52 commences to move down under the influence of the air valve spring 70, the fuel control member 54 commences to move down under the influence of the fuel compression spring 92. Since the fuel control member has lifted less than the air control member, the fuel control member closes first, shutting off the supply of fuel by seating the end 104 of the fuel control member against the fuel seat 106 while air is still flowing by the air seat 80. This helps to purge all of the fuel from the mixing chamber and insure that it is well atomized. The air control member 52 continues to move downwardly until the flange 78 closes against seat 80, shutting off the air flow until the next injection event when the actuator 18 is again activated.

In a typical injection system, the mass flow of air needed for satisfactory atomization of the fuel is equal to the mass flow of the fuel. Assuming the fuel pressure is equal to the air supply pressure, the ratio of the air valve seat area to the fuel valve seat area is on the order of 700. In the preferred embodiment, the air valve seat 80 has an opening with a diameter of 20 mm and the fuel valve seat has an opening defined by the orifice 98 of 0.76 mm. The design is adapted for use under typical pressure in the order of approximately 3 bar for both the fuel and air pressures. Typically, the fuel pressure should be kept higher than the air pressure to prevent backflow of air into the fuel line. In laboratory tests, the injector of FIGS. 3–6 has shown good frequency response in an operating range of 600 to 6,000 rpm. An alternative embodiment of the mixing chamber body for use with the injector valve 22 is shown in FIG. 7, and is designated by the reference number 236. The mixing chamber 236 is secured to the fuel valve body 34 in the manner previously described and may include a resilient compression seal 44 for sealing against fluid leakage. In the embodiment of FIG. 7, the fuel valve seat is defined by an integral boss 206 provided in the mixing chamber body 236. The boss 206 includes an upper seat surface 204 adapted for engaging the seating end 104 of the fuel control element 54, in the manner previously described for closing the fuel needle valve defined by the orifice 98. In this embodiment, the mixing chamber is defined by the open chamber area 208 disposed radially outward of the boss 204. A plurality of angular radial channels 205 are provided in the boss and intersect an axial bore 207 which is in communication with the machined discharge orifice 210 for releasing the atomized air/fuel mixture from the injector system.

An alternative dual action fuel injector 122 is shown in FIGS. 8 and 9. As there shown, the fuel injector includes an external casing 124 defining a peripheral air chamber 126. The air supply 28 (FIG. 1) is connected via the tube 128 provided in the upper end of the casing. A hollow stem 130 is also provided and is adapted for receiving the upper end of 132 of the plunger assembly 134.

As with the embodiment of FIGS. 3–7, the plunger assembly 134 is a dual action plunger having an air control member 136 and a fuel control member 138. In the embodiment shown, the air control number 136 has a through bore 140. The hollow stem 130 of the casing serves as the fuel inlet and is attached to the continuous fuel source 24 in the well known manner, providing for a flow of fuel into the bore 140. An internal shoulder or seat 144 is provided in the interior wall of stem 130 and is adapted for seating one end of the air valve compression spring 146. The opposite end of spring 146 is seated against the upper end 132 of the plunger assembly for urging the plunger assembly into its downwardmost position. The solenoid actuator 18 is mounted inside the casing and has a wiring control harness 147 for connecting the actuator 18 to the electronic control module 10 and to a suitable power source, in the manner well known, see also FIG. 1.

The air control member 136 is mushroom shaped with an enlarged head 148 having a threaded end bore 150 to which the threaded cylindrical center section 151 of an air disk valve 152 is secured. The cylindrical section 151 extends upwardly from the center of the air disc valve and is threadable received in the threaded bore 150. The hollow interior 142 of the cylindrical section is in communication with bore 140 and defines a fuel reservoir. The fuel control member 138 is mounted within the hollow cavity 142 and has an enlarged upper end 139 which is adapted for receiving and seating one end of a fuel compression spring 154. The opposite end of the spring 154 seats against the end wall of the threaded bore 150 in air control member 136. The lower end 155 of the fuel control member is adapted to seat against the fuel seat 156, as better shown in FIG. 9. The fuel seat 156 may be mounted in the mixing chamber 158 by a plurality of supports 160 which are suitably secured to the outer walls 162 of the mixing chamber. The fuel control member 138 includes a through bore 166 for defining a fuel delivery channel or needle valve for releasing fuel when the member 138 is lifted from seat 156.

In operation, when the solenoid actuator 18 is activated, it pulls the mushroom head 148 of the air control member upward to the end face 168 of the solenoid, against the air control spring 146. This lifts the disc valve 152 off of the air valve seat 170 and permits the air in the air chamber 126 to flow into the mixing chamber 158. After the gap 172 has been closed by sufficient movement of the disc valve 152 toward the actuator 18, whereby it engages the enlarged end 139 of the fuel control member, the fuel control member is lifted off of the fuel valve seat 156, permitting fuel to flow through the needle valve defined by bore 166 and into the mixing chamber. The lag time between the air flow and the fuel flow may be controlled by adjusting the axial positioned threaded cylinder 151 in the threaded bore 150 for enlarging or decreasing the gap 172 between the head 139 and the air disc valve 152.

A simplified injector 322 is shown in FIGS. 10 and 11 and includes a single action plunger for metering both the air flow and the fuel flow during the injection cycle. In this embodiment, the port configuration in the valve body controls both the metering and the timing of the air and fuel flow. As is specifically shown in FIGS. 10 and 11, the valve body 324 is of substantially cylindrical cross-section and includes an aperture 326 which is adapted to receive a threaded coupling for connecting the body directly to a source of pressurized air 28 (FIG. 1). A second threaded aperture 328 is adapted to receive a threaded coupling for connecting the valve body directly to a source of fuel 24 (also FIG. 1). A fuel tube 330 is provided in the body and is in communication with a fuel chamber 332. An enlarged radial air chamber 334 is also provided and is in communication with the air inlet 326. The valve body includes a through axial bore 336 adapted to receive and house the plunger assembly 338. The actuator 18 is secured to the top of the body in the well known manner and includes an abutment plate 344 or the like for limiting controlling the movement of the plunger assembly 338. A compression biasing spring 342 is placed between the abutment plate 340 and the upper end 344 of the plunger 338. The lower positive stop for the plunger is provided by the enlarged plunger shoulder 348, which is adapted to engage the upper end 350 of the valve body. The plunger 338 includes a first control portion 346 which is adapted to close and seal off the air chamber 334 when the valve is in its lowermost position. A second control section 352 is provided in the plunger and is adapted for closing and sealing the fuel chamber 332. A reduced plunger portion 354 spans the two control areas 346 and 352.

In operation, when the actuator 18 is activated, the plunger 338 is moved upward against the spring 342 until the tapered end 356 of control position 346 passes the edge of the air chamber 334, releasing air into the central bore 336 and into peripheral, valve parallel body channels 358, to release a flow of air. As the plunger 338 continues its upward movement, the tapered end 360 of the fuel control portion 352 passes the edge of the fuel chamber 332, and releases fuel into the central bore 336 where it is mixed with the flowing air. The air fuel mixture is then released through the outer end 362 of the central bore 336 and into a suitable mixing and/or transfer system.

When the actuator 18 is deactivated, the force of spring 342 forces the plunger downward and the fuel control member 352 first closes the fuel chamber 332, permitting the continuing flow of air to purge the fuel out of the central bore 336. When the plunger is urged to its downward, closed position, the air control member 346 closes the air chamber 334 and flow is stopped until the next injection cycle. The single action plunger mechanism is ideal for use where a fixed calibration between the fuel and the air flow is acceptable and is particularly well suited where inexpensive injectors are to be employed.

While certain features and embodiments of the invention have been described in detail herein, it should be readily understood that the invention includes all modifications and enhancements within the scope and spirit of the following claims.

What is claimed is:

1. An apparatus for injecting a fuel/air mixture into the mixture delivery system for an internal combustion engine, comprising:

a. a mixing chamber having a fuel inlet, an air inlet and a mixture outlet, the mixture outlet in communication with the mixture delivery system for introducing mixture from the mixing chamber to the mixture delivery system on a cycled basis;

b. means for intermittently introducing a metered flow of liquid fuel through the fuel inlet and into the mixing chamber on a cycled basis;

c. means for intermittently introducing a metered flow of pressurized air into the mixing chamber on a cycled basis when liquid fuel is present for breaking the fuel into droplets;

d. control means for sequencing the flow of fuel and the flow of pressurized air such that the flow of pressurized air into the mixing chamber eclipses the flow of fuel into said chamber, whereby pressurized air is always present during the fuel introduction portion of the cycle.

2. The apparatus of claim 1, wherein the pressurized air is utilized to evacuate the mixture from the mixing chamber through the mixture outlet and into the mixture delivery system.

3. The apparatus of claim 1, wherein the mixture delivery system includes a manifold for distributing the mixture to a plurality of combustion chambers in the internal combustion engine and there is at least one mixture outlet associated with the combustion chambers.

4. The apparatus of claim 1, wherein the fuel delivery system is adapted for injecting fuel from the fuel outlet directly into the combustion chamber of the internal combustion engine.

5. The apparatus of claim 1, wherein the control means includes a single control valve for controlling both the metered air flow and the metered fuel flow into the mixing chamber.

6. The apparatus of claim 5, the control valve further comprising:

a. a valve body having an valve air inlet and a separate valve fuel inlet;

b. a mixing chamber;

c. a valve air outlet and a separate valve fuel outlet in communication with the valve air inlet and the valve fuel inlet, respectively, for introducing air and fuel into the mixing chamber;

d. a control element selectively movable between closed and open positions, the control element normally closed for preventing the flow of air and fuel into the mixing chamber and having a first open position allowing air to flow through the valve air outlet into the mixing chamber and a second open position for allowing fuel to flow through the valve fuel outlet into the mixing chamber; and e. an actuator for selectively moving the control element between the closed and open positions.

7. The apparatus of claim 6, further including:

a. means for continuously introducing air into the valve air inlet; and b. means for continuously introducing fuel into the valve fuel inlet.

8. The apparatus of claim 6, wherein the control element further includes:

a. an air control member responsive to the actuator and adapted to move between closed and open positions relative to the valve air outlet, whereby air is introduced into the mixing chamber; and b. a fuel control member responsive to the actuator and adapted to move between closed and open positions relative to the valve fuel outlet, whereby fuel is introduced into the mixing chamber.

9. The apparatus of claim 8, further including a first biasing element for biasing the air control member into the closed position and a second biasing element for biasing the fuel control member into the closed position.

10. The apparatus of claim 6, wherein the control element further includes a single control member having a plurality of sequential fully closed, first open and second open positions for sequentially opening the valve air outlet, the valve fuel outlet, closing the valve fuel outlet and closing the valve air outlet, in that order.

11. The apparatus of claim 10, further including a biasing element for biasing the single control member into the fully closed position.

12. The apparatus of claim 10, wherein the single control member further comprises a valve spool movable in the valve body between closed, first open and second open positions, and wherein the valve air outlet is in the opened position when the valve spool is in the first and second open positions and the valve fuel outlet is opened only when the valve spool is in the second open position.

13. The apparatus of claim 1, further including an air inlet into the mixing chamber which is separate from the fuel inlet, for introducing the pressurized air into the mixing chamber.

14. The apparatus of claim 13, wherein the fuel is supplied to the mixing chamber under pressure at a pressure substantially equal to the pressure of the pressurized air and wherein the air inlet opening is larger than the fuel inlet opening by a factor on the order of approximately 700.

15. The apparatus of claim 13, wherein the fuel is supplied to the mixing chamber under pressure at a pressure substantially equal to the pressure of the pressurized air, and wherein the fuel inlet opening is of circular cross-section with a diameter of approximately 0.76 mm and the air inlet opening is of circular cross-section with a diameter of approximately 20 mm.

16. The apparatus of claim 8, wherein the air control member is directly controlled by the actuator and wherein the fuel control member is responsive to movement by the air control member.

17. The apparatus of claim 16, further including a calibration mechanism between the air control member and the fuel control member adapted for adjusting the movement of the fuel control member relative to the air control member.

18. The apparatus of claim 16, wherein the air control member is a primary valve spool housed in the valve body and wherein the fuel control member is a secondary vale spool carried in the primary valve spool and independently movable relative thereto.

19. The apparatus of claim 18, the valve body further including a primary valve seat containing the valve air outlet and a secondary valve seat containing the valve fuel outlet, and wherein the primary valve spool seats against the primary valve seat for closing the valve air outlet when in the closed position and the secondary valve spool seats against the secondary valve seat for closing the valve fuel outlet when in the closed position.

20. The apparatus of claim 19, the primary valve spool including means for engaging and moving the secondary valve spool from the secondary seat in response to movement of the primary valve spool by the actuator.

21. The apparatus of claim 20, further including a calibration mechanism for adjusting the position of the primary valve spool relative to the secondary valve spool, whereby the primary valve spool is required to move a predetermined distance prior to movement of the secondary valve spool.

22. A method of controlling the injection of fuel and pressurized air into a fuel delivery system for an internal combustion engine utilizing a single moveable control component, the method comprising the steps of:

a. moving the single moveable control component from a first selected position to a second selected position for introducing a metered flow of pressurized air into the fuel delivery system on a cycled basis to create an air stream;

b. moving the single moveable control component from the second selected position to a third selected position for initiating a metered flow of liquid fuel into the fuel delivery system, wherein the pressurized air is introduced into the fuel delivery system prior to and at all times when the liquid fuel is introduced for breaking the liquid fuel into finite droplets in the air stream and for transporting the liquid droplets through the fuel delivery system; and c. returning the single moveable control component from the third selected position serially through the second selected position to the first selected position for ceasing the flow of pressurized air in the fuel delivery system only after liquid fuel ceases being introduced into the fuel delivery system.

23. The method of claim 22, wherein the timing of steps (a), (b) and (c) may be calibrated by adjusting the distance between the selected positions and the speed of movement of the single moveable control element.

24. The method of claim 22, wherein the flow of liquid fuel and the flow of pressurized air are at approximately the same pressure.

25. The method of claim 24, wherein the flow of liquid fuel and the flow of pressurized air are both at a pressure of approximately three times atmospheric pressure.

26. A fuel injector valve for providing an atomized fuel/air mixture to an internal combustion engine, comprising, c. a valve body having an axial through bore;

d. a plunger axially movable in the bore and having an outer diameter defining a sealing relationship therewith;

e. a pair of ports in the body, the first body port in communication with a flow of pressurized air and the second body port in communication with a source of liquid fuel;

f. a mixing chamber in the body and in communication with the plunger;

g. a fuel release orifice in communication with the mixing chamber;

h. a first control member in the plunger adapted to be selectively positioned for opening and closing the first body port and the mixing chamber for delivering a flow of pressurized air into the mixing chamber when open;

i. a second control member in the plunger adapted to be selectively positioned for opening and closing the second body port and the mixing chamber for delivering a flow of liquid fuel into the mixing chamber when open, wherein the second body port is open and in communication with the mixing chamber only after and during the period when the first body port is open and in communication with the mixing chamber.

27. The fuel injector valve of claim 26, the valve plunger being of a construction such that axial movement of the plunger places the first body port in communication with the mixing chamber before, during and after the second body port is in communication with the mixing chamber.

28. The fuel injector valve of claim 27, wherein the first and second control members channels are longitudinally spaced peripheral channels in the plunger.

29. The fuel injector valve of claim 27, wherein:

a. the first control member is an air control member adapted to move between closed and open positions relative to the first body port; and b. the second control member is a fuel control member adapted to move between closed and open positions relative to the second body port.

30. The fuel injector valve of claim 29, further including a first biasing element for biasing the air control member into the closed position and a second biasing element for biasing the fuel control member into the closed position.

31. The fuel injector valve of claim 30, wherein the air control member is a primary valve spool housed in the valve body and wherein the fuel control member is a secondary valve spool carried in the primary valve spool and movable independently relative thereto.

32. The fuel injector of claim 31, the valve body further including a primary valve seat containing the first body port and a secondary valve seat containing the second body port, and wherein the primary valve spool seats against the primary valve seat for closing the first body port when in the closed position and the secondary valve spool seats against the secondary valve seat for closing the second body port when in the closed position.

33. The fuel injector of claim 32, the primary valve spool including means for engaging and moving the secondary valve spool from the secondary seat in response to movement of the primary valve spool.

34. The fuel injector valve of claim 33, further including a calibration mechanism for adjusting the position of the primary valve spool relative to the secondary valve spool, whereby the primary valve spool is required to move a predetermined distance prior to movement of the secondary valve spool.

* * * * *